US005542739A

United States Patent [19]

Hultman

[11] Patent Number: 5,542,739

[45] Date of Patent: Aug. 6, 1996

[54] FOLDING FURNITURE

[76] Inventor: Ake Hultman, Bohusgatan 24, S-411 39, Göteborg, Sweden

[21] Appl. No.: 407,759

[22] Filed: Mar. 21, 1995

[51] Int. Cl.[6] ..... A47C 4/00

[52] U.S. Cl. ..... 297/56; 297/41

[58] Field of Search ..... 297/56, 55, 41, 297/35, 39

[56] References Cited

U.S. PATENT DOCUMENTS

| | | | |
|---|---|---|---|
| 2,741,298 | 4/1956 | Roberts III | 297/56 X |
| 2,762,057 | 9/1956 | Root | 297/56 X |
| 3,907,359 | 9/1975 | Joiner | 297/56 X |
| 4,765,679 | 8/1988 | Lanuzzi et al. | 297/312 X |
| 5,058,950 | 10/1991 | Mann | 297/35 X |

FOREIGN PATENT DOCUMENTS

| | | | |
|---|---|---|---|
| 621843 | 5/1927 | France | 297/56 |
| 510240 | 10/1930 | Germany | 297/56 |

*Primary Examiner*—Milton Nelson, Jr.
*Attorney, Agent, or Firm*—Dvorak and Traub

[57] ABSTRACT

A foldable article of furniture, such as a chair, has a support surface or a seat portion, pivotally connected to an underlying support leg. The support surface comprises a first section and a second section, each of which is pivotally connected to one of the support legs, as well as to each other. In this way, a neatly and compactly foldable article is provided without requiring any sliding pivots or joints.

5 Claims, 3 Drawing Sheets

FOLDING FURNITURE

FIELD OF THE INVENTION

The invention relates to a foldable article of furniture, said article being provided with a support surface pivotally connected to underlying support leg means.

In particular the invention relates to articles of furniture which are more commonly known as foldable or collapsible items, such as collapsible chairs, collapsible benches or the like.

BACKGROUND TO THE INVENTION

Articles of furniture of the aforementioned type are known for example from U.S. Pat. No. 2,794,492 and U.S. Pat No. 2,574,387.

These prior art arrangements, which relate to folding chairs, have a foldable structure which comprises either a sliding pivot joint or a hook type connection of the individual elements at at least one location. Thus, whilst the chairs can fold into a relatively compact shape in their folded-away position, the slide and hook arrangements of these types of chairs are prone to jamming, sticking and difficulties with locating the elements with respect to each other. This is particularly the case when the chair has been used many times and the components become worn or dirty, or for example where the material of the chair is subject to age variations (e.g. wooden chairs).

One solution to the problem with sliding joints has been to provide high precision components and high quality surface finishes for the joint assemblies such that the sliding movements result in less wear due to low friction. However, even with such precision, lubrication is often required on the sliding surfaces after much handling, which lubrication is unsightly and may cause damage or staining if the chairs are made of wood.

A further problem which arises with such foldable chairs is the difficulty of handling the chair in order to collapse or unfold it. For example, only with very lightweight chairs is the construction according to U.S. Pat. No. 2,574,387 easily usable, since the chair must first be lifted in order to effect folding.

One of the objects of the present invention is thus to arrive at an article of furniture which does not require sliding joints and in particular sliding pivot joints.

A further object of the invention is to arrive at an article of furniture which is readily foldable into a collapsed (folded-away) position and into a position of use (folded-out position).

SUMMARY OF THE INVENTION

The invention aims to overcome the disadvantages associated with the above mentioned types of chairs and with other known articles of folding furniture by a novel construction which allows easy manageability without requiring the use of any sliding pivot joints or hook connections.

Further objects and advantages of the invention will be apparent to the skilled man upon reading the following description of the preferred embodiment, which is described with reference to accompanying drawings.

DESCRIPTION OF A PREFERRED EMBODIMENT

Figure 1:
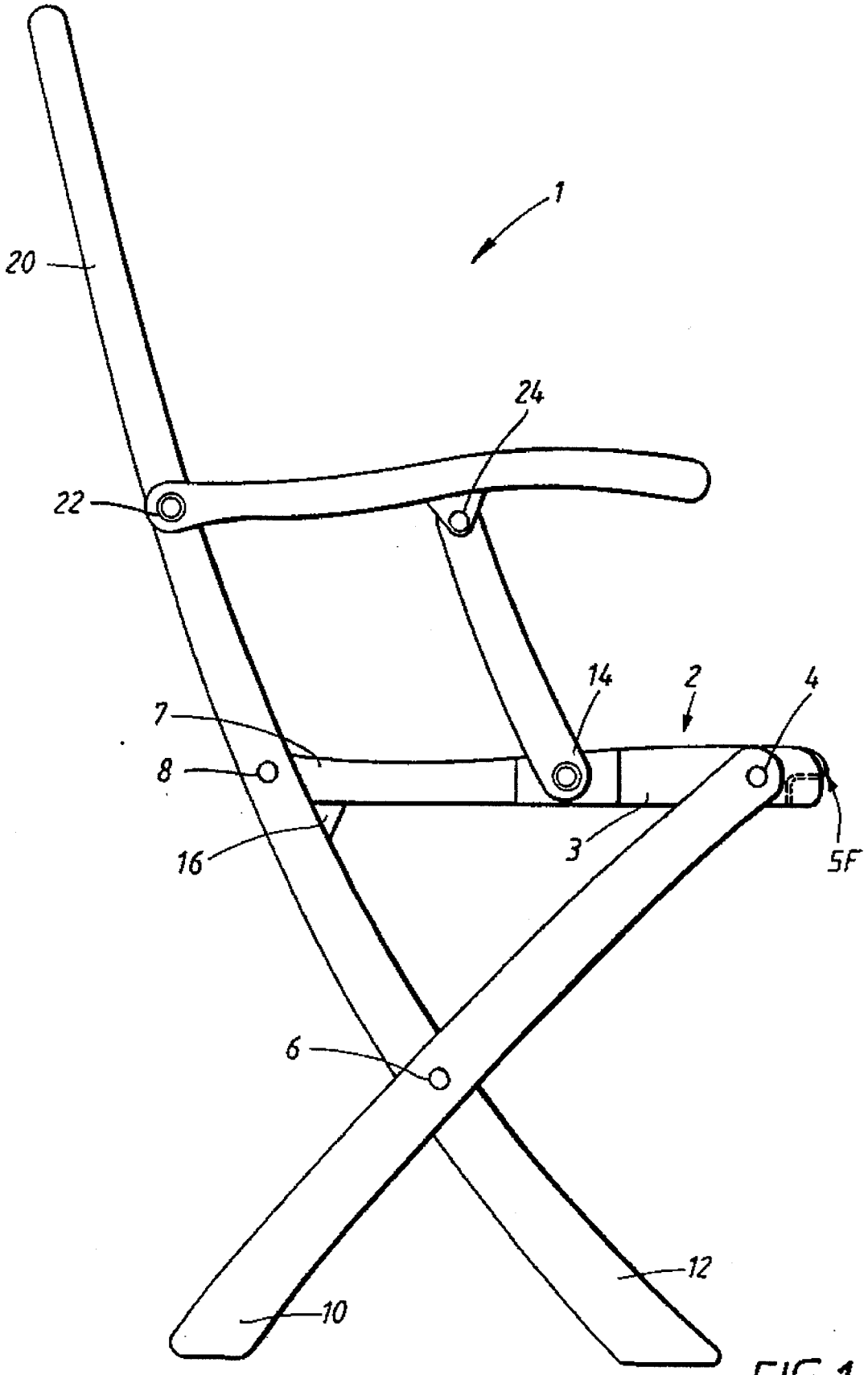
FIG. 1 shows a side view of a chair constructed in accordance with the invention in a folded-out position.

FIG. 1 shows an article of furniture 1 which, in the preferred embodiment, is a chair. The chair is generally symmetrical about a plane passing through the middle of the seat, i.e. midway between the two armrests 34 and 36 (see FIG. 2), although the provision of no armrests, only one armrest or more than two armrests is possible.

Figure 3:
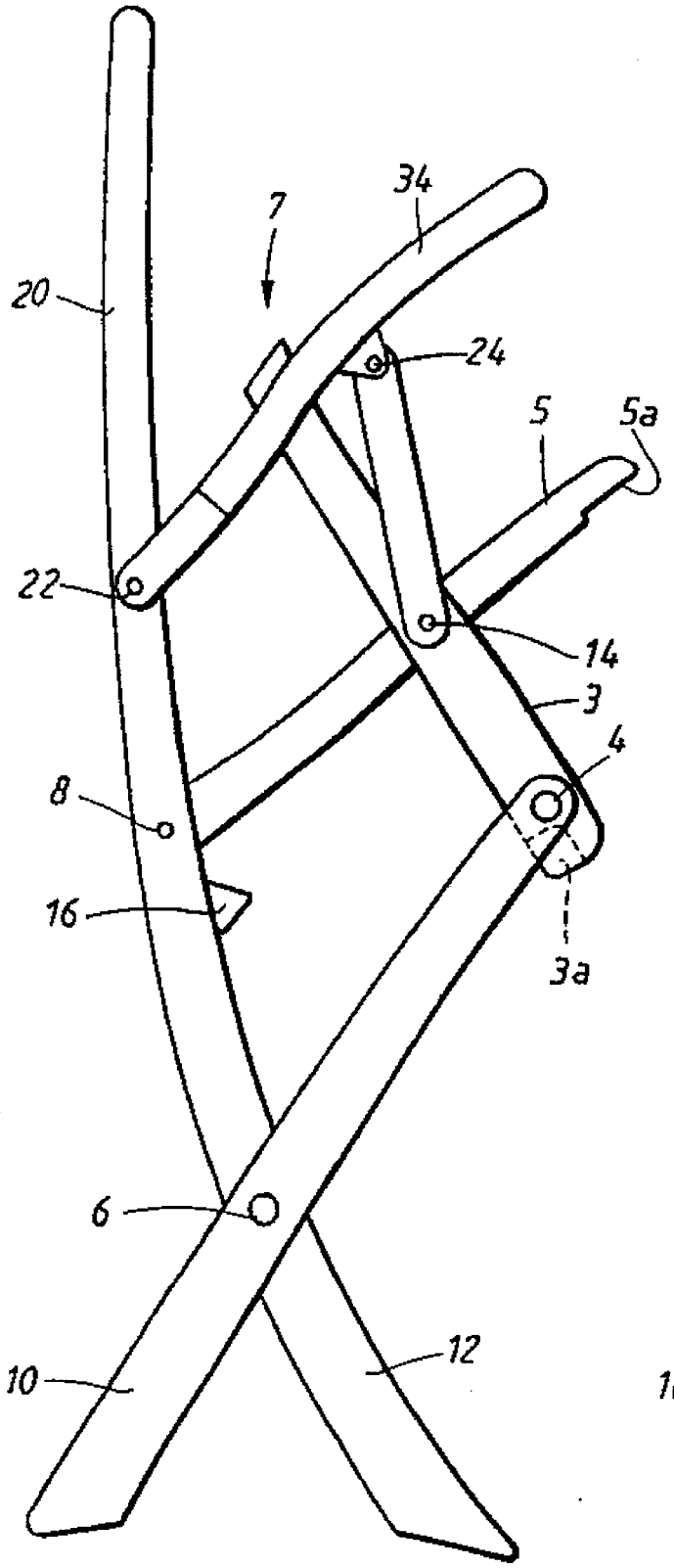
FIG. 3 shows a side view of the chair of FIG. 1 in an intermediate folded position.

The chair has a support surface 2 which is formed by two relatively rigid sections, a first section 3 and a second section 5 (see FIG. 3). These sections 3, 5 are pivotally connected to each other by means of a pivot pin 14, located approximately mid-way between the pivots 4 and 8. The pivots 4 and 8 in turn designate the respective pivot connection locations of the sections 3 and 5 to the underlying support leg means 10 and 12, each of which has two respective leg portions 10A, 10B, 12A, 12B contacting the ground, thus providing a total of four spaced supporting locations. Other types of support leg means are however imaginable.

The support leg means 10 and 12 are joined to one another at a fourth pivot pin location 6 positioned approximately equidistantly from the base of each of the leg means 10 and 12 respectively.

Figure 2:
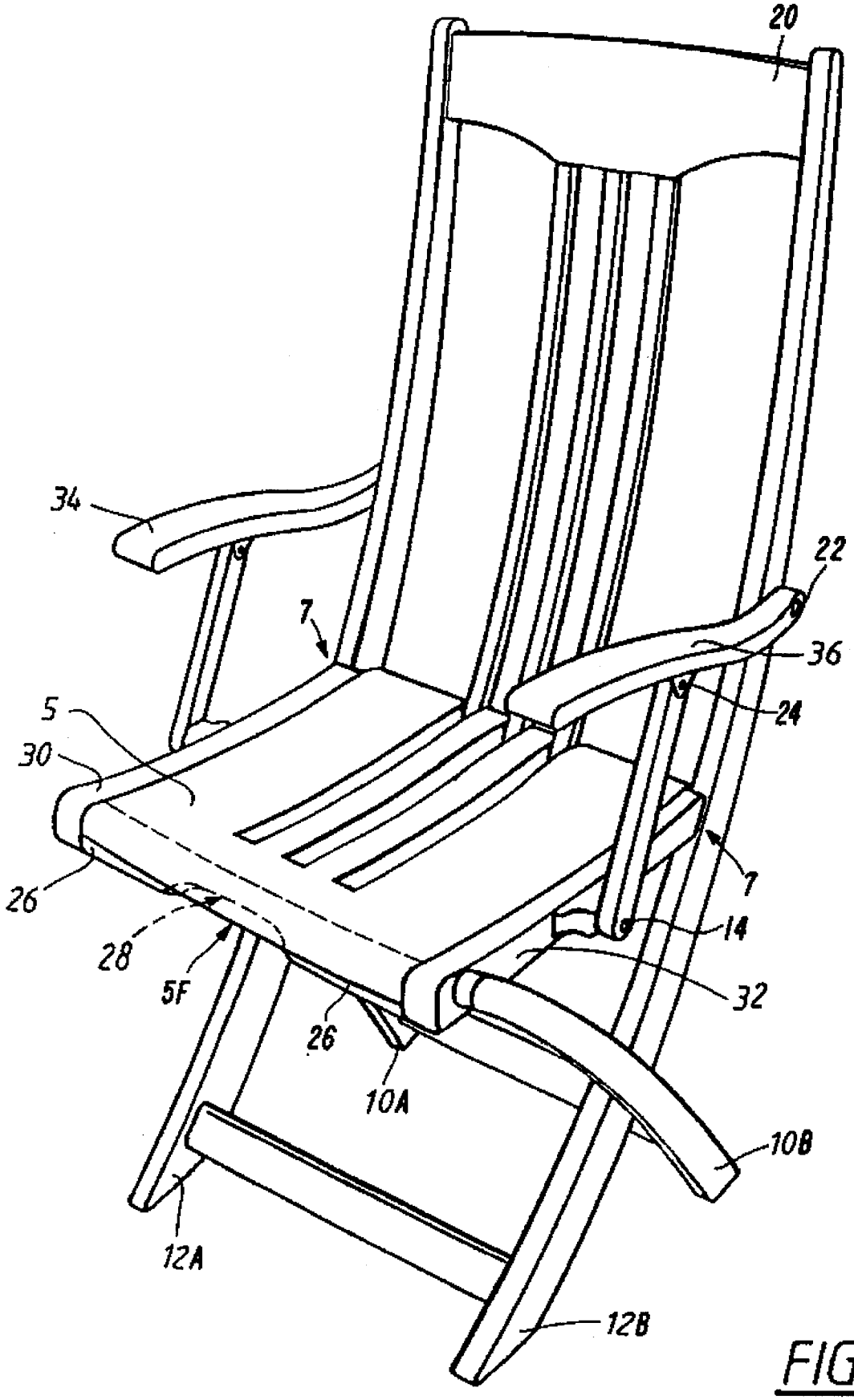
FIG. 2 shows a perspective view of the chair of FIG. 1.

As can be seen more clearly in FIG. 2 and FIG. 3, the first section 3 is formed as a substantially U-shaped fram (as seen from above) which has two arms 30, 32, lying on respective sides of the second section 5. The arm 30 is connected to arm 32 proximate the front edge of the chair by a cross member 26.

The first section 3 has two free ends 7 which are supported on the backrest 20 of the chair by means of a cross brace 16 spanning the two leg portions 12A, 12B, which comprise the support leg means 12.

At the front edge of the chair the first section and the second section are each provided with cooperating portions 3*a* and 5*a* respectively. In the folded-out position as shown in FIG. 1, the portion 5*a* overlies and is supported on the portion 3*a* (normally formed on member 26), as shown in hidden detail lines in FIG. 1. This provides a very stable and secure construction for the chair since any load applied to the surface 2 is taken by sections 3 and 5 which are each supported by the cross brace 16 as well as the section 5 being supported by the front edge arrangement of 3*a* and 5*a*. With such an arrangement the third pivot pin 14 will thus be in a relatively unloaded condition.

The cross member 26 may also be provided with a cut-away portion 28 to allow easy access to the front lip 5F of the section 5, in order that a user may easily grip the front lip for folding away the chair.

In the embodiment illustrated, the member 26 lies behind the front lip 5F of the second section 5 (see e.g. FIG. 1). However the member 26 may itself form the front lip of the support surface. If desired, in this case, easier access can be gained to the second section 5 (for folding away) by the provision of a cut away portion (not shown), similar to the shape 28, allowing insertion of a hand between the member 26 and the second section 5.

The chair may be provided with an arm rest portion 34, 36 which is pivotally connected, as shown in FIG. 1, at locations 14, 22 and 24. In this way, the third pivot pin 14 may serve as the pivot location not only for connecting the two sections 3 and 5, but also for the armrest.

Precise details of the pivot connections are not shown in the figures, but it will be clear to the skilled person that the pivots may be of any suitable type. For example the pivot 24 need not be a pin connection but could be a hinge type for instance. Similarly the pivot 8 may extend as one pin through the whole second section 5, but may be formed as two separate pin sections extending from either side to whatever distance is appropriate.

Figure 4:
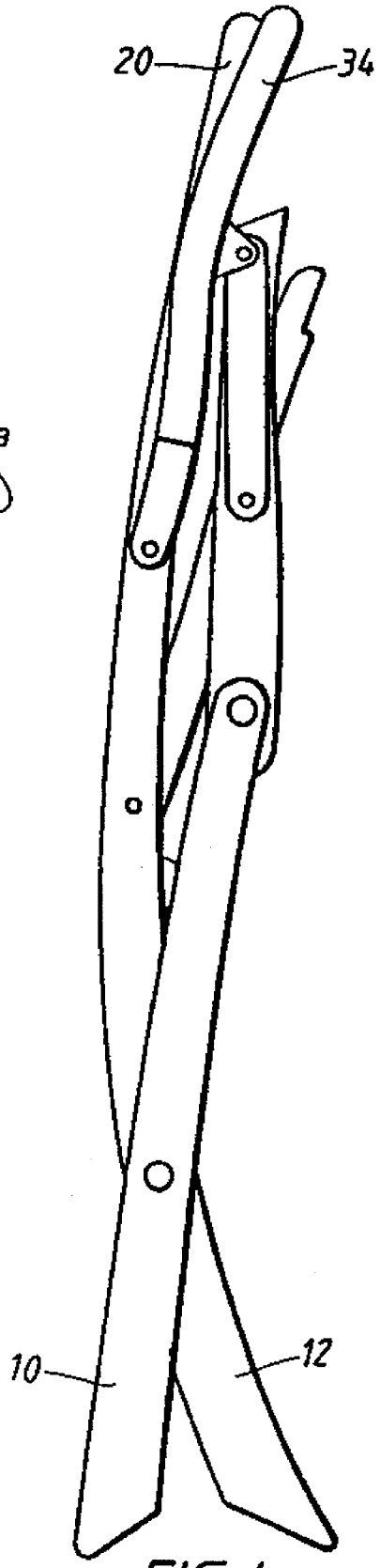
FIG. 4 shows a final folded position of the chair of FIG. 1.

In order to fold the seat away from its folded-out position in FIG. 1 and FIG. 2, the user may take hold of the front edge of the second section 5, e.g. on the part 5*a*, and lift upwardly whilst preventing the leg means 10 from moving backwardly. Continued upward movement of the section 5 will thus collapse the chair fully into the position shown in FIG. 4. Folding-out again is merely a matter of moving the second section 5 downwardly.

Folding away of the chair may also be accomplished by lifting one of the members 30, 32 of the first section and moving this upwardly. When no armrest is provided it will be clear that no obstacle prevents continuous upward movement from the sides of the chair and similarly when only one armrest is provided, access will be easiest from the side with no armrest.

Whilst it is not essential, the comfort of the chair can be enhanced by arranging the height of the sections 3 and 5 to be such that the upper surfaces of sections 3 and 5 of the seat 2 are substantially at the same level. This can be achieved by appropriate location of the third pivot pin 14 with respect to the chosen material depth of each of the sections 3 and 5 at the pivot location 14.

The resultant chair is thus stable, easily manageable even when heavy (e.g. large wooden chairs) and obviates the use of sliding hinges, sliding pivots or fastening means such as hooks.

Whilst the invention has been described with reference to the embodiment shown in the drawings, it will be appreciated by those skilled in the art that many variations are possible within the scope of the invention as defined by the appended claims. For example, whilst the invention has been explained with reference to a chair, other articles of furniture are also encompassed by the invention such as foldable tables, stools, benches and the like which provide a support surface for articles or people.

I claim:

1. A foldable chair having a generally upright backrest and a generally horizontal supporting surface pivotably connected to a pair of underlying support leg means for supporting said chair on a floor surface, said backrest integrally joined to one of said underlying support leg means, said supporting surface connected to said first support leg means at a first pivot pin and to said second support leg means at a second pivot pin, said first and second pivot pins generally lying on a common horizontal plane, said supporting surface defined by a first rigid section and a second rigid section, each of said rigid sections having a respective front and back edge, said first rigid section having a generally U-shaped configuration that forms an outer frame of said chair, said U-shaped configuration formed by a first and a second arm interconnected together by a cross member, said first and second arms each having a free end, wherein said second rigid section is received within said U-shape of said first rigid section and is generally coextensive therewith, said second rigid section having a front lip defining said front edge of said second section, said first and second sections pivotably connected to each other at a third pivot pin which is generally midpoint between said front and back edge of said first rigid section and between said first and second pivot pins, said third pivot pin generally lying on said common horizontal plane, said front edge of said second rigid section being supported on said cross member when said chair is in a folded-out position and said back edge of said first rigid section being supported at said free ends of said first and second arms by a cross brace when in said folded-out position, said cross brace interconnecting said second support leg means, wherein operation of said chair between a folded position and said folded-out position obviates the use of a sliding hinge, a sliding pivot or a hook.

2. The foldable chair according to claim 1, wherein the upper surface of the first section and the upper surface of the second section are horizontally coextensive when in said folded-out position.

3. The folding chair according to claim 1, wherein all said pivot pins are substantially fixed with respect to said chair, so that no sliding pivot pins are provided.

4. The folding chair of claim 21, wherein said cross member is provided with a recessed portion in order to provide easy access to the front edge of the second section.

5. The folding chair of claim 4 further including at least one arm rest, said arm rest being horizontally disposed above said supporting surface and being pivotally connected to said backrest at a position vertically above said second pivot pin and indirectly connected to said third pivot pin such that said arm rest is supported by said first rigid section when said chair is in said folded-out position.

* * * * *